US006867666B1

(12) United States Patent
Rawnick et al.

(10) Patent No.: US 6,867,666 B1
(45) Date of Patent: Mar. 15, 2005

(54) VARIABLE FILTER USING FLUID DIELECTRIC

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 25 days.

(21) Appl. No.: 10/647,749

(22) Filed: Aug. 25, 2003

(51) Int. Cl.[7] ..... H03H 7/12
(52) U.S. Cl. ..... 333/174; 333/99 R; 333/205
(58) Field of Search ..... 333/99 R, 158, 333/174, 179, 205

(56) References Cited

U.S. PATENT DOCUMENTS 5,162,972 A 11/1992 Gripshover et al.
6,515,235 B2 2/2003 Moller

OTHER PUBLICATIONS

U.S. Appl. No. 10/369,436, filed Feb. 18, 2003.
U.S. Appl. No. 10/387,208, filed Mar. 11, 2003.
U.S. Appl. No. 10/330,755, filed Dec. 27, 2002.
U.S. Appl. No. 10/330,754, filed Dec. 27, 2002.
U.S. Appl. No. 10/300,456, filed Nov. 19, 2002.
U.S. Appl. No. 10/361,548, filed Feb. 10, 2003.
U.S. Appl. No. 10/387,209, filed Mar. 11, 2003.
U.S. Appl. No. 10/439,094, filed May 15, 2003.
U.S. Appl. No. 10/387,194, filed Mar. 11, 2003.
U.S. Appl. No. 10/438,435, filed May 15, 2003.
U.S. Appl. No. 10/414,696, filed Apr. 16, 2003.
U.S. Appl. No. 10/1637,027, filed Aug. 7, 2003.
U.S. Appl. No. 10/414,650, filed Apr. 16, 2003.
U.S. Appl. No. 10/635,629, filed Aug. 6, 2003.
U.S. Appl. No. 10/459,067, filed Jun. 11, 2003.
U.S. Appl. No. 10/438,436, filed May 15, 2003.
U.S. Appl. No. 10/626,090, filed Jul. 24, 2003.
U.S. Appl. No. 10/635,582, filed Aug. 6, 2003.
U.S. Appl. No. 10/632,632, filed Aug. 1, 2003.
U.S. Appl. No. 10/614,149, filed Jul. 7, 2003.
U.S. Appl. No. 10/634,219, filed Aug. 5, 2003.
U.S. Appl. No. 10/458,859, filed Jun. 11, 2003.
U.S. Appl. No. 10/624,378, filed Jul. 22, 2003.
U.S. Appl. No. 10/438,433, filed May 15, 2003.
U.S. Appl. No. 10/460,947, filed Jun. 13, 2003.
U.S. Appl. No. 10/421,352, filed Apr. 23, 2003.
U.S. Appl. No. 10/409,261, filed Apr. 8, 2003.
U.S. Appl. No. 10/441,743, May 19, 2003.
U.S. Appl. No. 10/628,846, filed Jul. 28, 2003.
U.S. Appl. No. 10/448,973, filed May 30, 2003.

*Primary Examiner*—Robert Pascal
*Assistant Examiner*—Dean Takaoka
(74) *Attorney, Agent, or Firm*—Sacco & Associates, PA

(57) ABSTRACT

A variable RF filter (102) which includes one or more filter elements (104,106). The filter elements (104,106) can be formed from a structure selected from the group consisting of stripline, microstrip, and buried microstrip. A fluid dielectric (108) and a fluid control system (150) for selectively moving the fluid dielectric from a first position to a second position are provided. In the first position, the fluid dielectric (108) is electrically and magnetically coupled to the filter elements (104,106) to produce a first filter response. In the second position, the fluid dielectric (108) is electrically and magnetically decoupled from the filter elements (104,106) to produce a second filter response distinct from the first filter response. The first position can be defined by a bounded region located adjacent to the filter elements (104,106) and the second position is defined by a fluid storage reservoir (170).

23 Claims, 4 Drawing Sheets

VARIABLE FILTER USING FLUID DIELECTRIC

BACKGROUND OF THE INVENTION

1. Statement of the Technical Field

The inventive arrangements relate generally to methods and apparatus for providing increased design flexibility for RF circuits, and more particularly to variable microstrip, buried microstrip and stripline filters.

2. Description of the Related Art

A filter is a frequency-selective signal transmission device in which certain ranges of frequencies (the passband) are passed from an input to an output, while other ranges (the stopband) are rejected. Filters can be formed in many different ways. For example, one configuration, known as microstrip, places conductive traces (filter elements) on a board (substrate) surface and provides a second conductive layer, commonly referred to as a ground plane. Microstrip filter elements are each designed to have a specific impedance and/or signal response, which are determined by the trace geometry and the dielectric properties of the substrate material. Further, the conductive traces are arranged on the substrate in accordance with a selected filter topology. A second configuration, known as buried microstrip, is similar to microstrip except that the filter elements are covered with a dielectric substrate material. In a third configuration, known as stripline, the filter elements sandwiched within substrate between two electrically conductive (ground) planes. In all cases, the characteristics of the filter are determined in part by the electrical properties of the material (e.g. substrate) in which the conductive elements of the filter are embedded.

Two critical factors affecting the performance of a substrate material are permittivity (sometimes called the relative permittivity or $\in_r$) and permeability (sometimes referred to as relative permeability or $\mu_r$). The relative permittivity and permeability determine the propagation velocity of a signal, which is approximately inversely proportional to $\sqrt{\mu\in}$, and therefore affect the electrical length of a filter element. Further, ignoring loss, the characteristic impedance of a filter element, such as stripline or microstrip, is equal to $\sqrt{L_1/C_1}$ where $L_1$ is the inductance per unit length and $C_1$ is the capacitance per unit length. The values of $L_1$ and $C_1$ are generally determined by the permittivity and the permeability of the dielectric material(s) used to separate the filter elements from other transmission line structures as well as the physical geometry and spacing of the filter elements and transmission line structures.

In a conventional RF design, a substrate material is selected that has a relative permittivity value suitable for the design. Notably, conventional substrate materials typically have a relative permeability of approximately 1.0. Once the substrate material is selected, the filter response is exclusively adjusted by controlling the topology of the filter and the geometry and physical structure of the filter elements.

One problem encountered when designing such filters is that the filters are generally optimized only for a predetermined passband and stopband at a predetermined impedance. If the filter is designed to have a wide passband to pass multiple signals at different frequencies, a greater amount of noise and undesired signals that happen to be in the filter's passband also will be propagated through the filter. On the other hand, if the filter is designed to have a narrow passband which limits the amount of noise and undesired signals that pass through the filter, only a limited range of desired signals will then be able pass through the filter. Modern RF circuits, however, commonly process multiple signals operating on different frequencies. An approach to address this dilemma is to make frequency selective properties of the filter variable. State of the art approaches to making the frequency selective properties variable generally include the use of mechanical means to alter the arrangement of the conducting elements of the filter, introducing a nonlinear component, such as a variactor, or digitizing the signal and implementing the frequency selection by numerical processing. Some approaches also vary the position or size of a dielectric component, for example a ferromagnetic inductor core whose position relative to inductor coil windings is varied by a screw mechanism, or a piezo-crystal whose dimension is varied in the presence of an electric field. However, such approaches provide only a limited range of adjustment for the frequency selective properties of the filter.

SUMMARY OF THE INVENTION

The present invention relates to a variable RF filter which includes one or more filter elements. The filter elements can be formed from a structure selected from the group consisting of stripline, microstrip, and buried microstrip. The present invention also includes a fluid dielectric and a fluid control system for selectively moving the fluid dielectric from a first position to a second position. In the first position, the fluid dielectric is electrically and magnetically coupled to the filter elements to produce a first filter response. Further, the amount of fluid dielectric in the first position can be adjusted. In the second position, the fluid dielectric can be coupled differently to the filter elements or can be electrically and magnetically decoupled from the filter elements to produce a second filter response distinct from the first filter response. The first position can be defined by a bounded region located adjacent to the transmission line and the second position is defined by a fluid storage reservoir. The bounded region can be bounded by a solid conductive material and/or a solid dielectric material.

At least one electrical characteristic of the filter response is changed when the fluid dielectric is moved from the first position to the second position. For example, filter passband, a stopband, a center frequency, a bandwidth, a quality factor (Q), and/or a characteristic impedance associated with the filter can be changed. The fluid control system can be responsive to a control signal and can include a pump for moving the fluid dielectric between the first position and the second position. In one arrangement, the fluid control system can replace the fluid dielectric with a second fluid dielectric responsive to the control signal.

DETAILED DESCRIPTION OF THE PREFERRED EMBODIMENTS

The present invention provides the circuit designer with an added level of flexibility by permitting a fluid dielectric to be used in an RF circuit, thereby enabling the dielectric properties proximate to a microstrip, a buried microstrip, and a stripline filter (herein after collectively referred to as filter) to be varied so that a particular filter can be used over a broad frequency range. Since propagation velocity is inversely proportional to $\sqrt{\mu\in}$, increasing the permeability ($\mu$) and/or permittivity ($\in$) in the dielectric decreases propagation velocity of a signal on filter elements coupled to the dielectric, and thus the signal wavelength. Further, the permittivity and/or permeability can be chosen to result in desired impedances (Z) for the filter elements as well. Accordingly, a filter of a given size can be used over a broad range of frequencies and for different circuit impedances without altering the physical dimensions of the filter.

Figure 1:
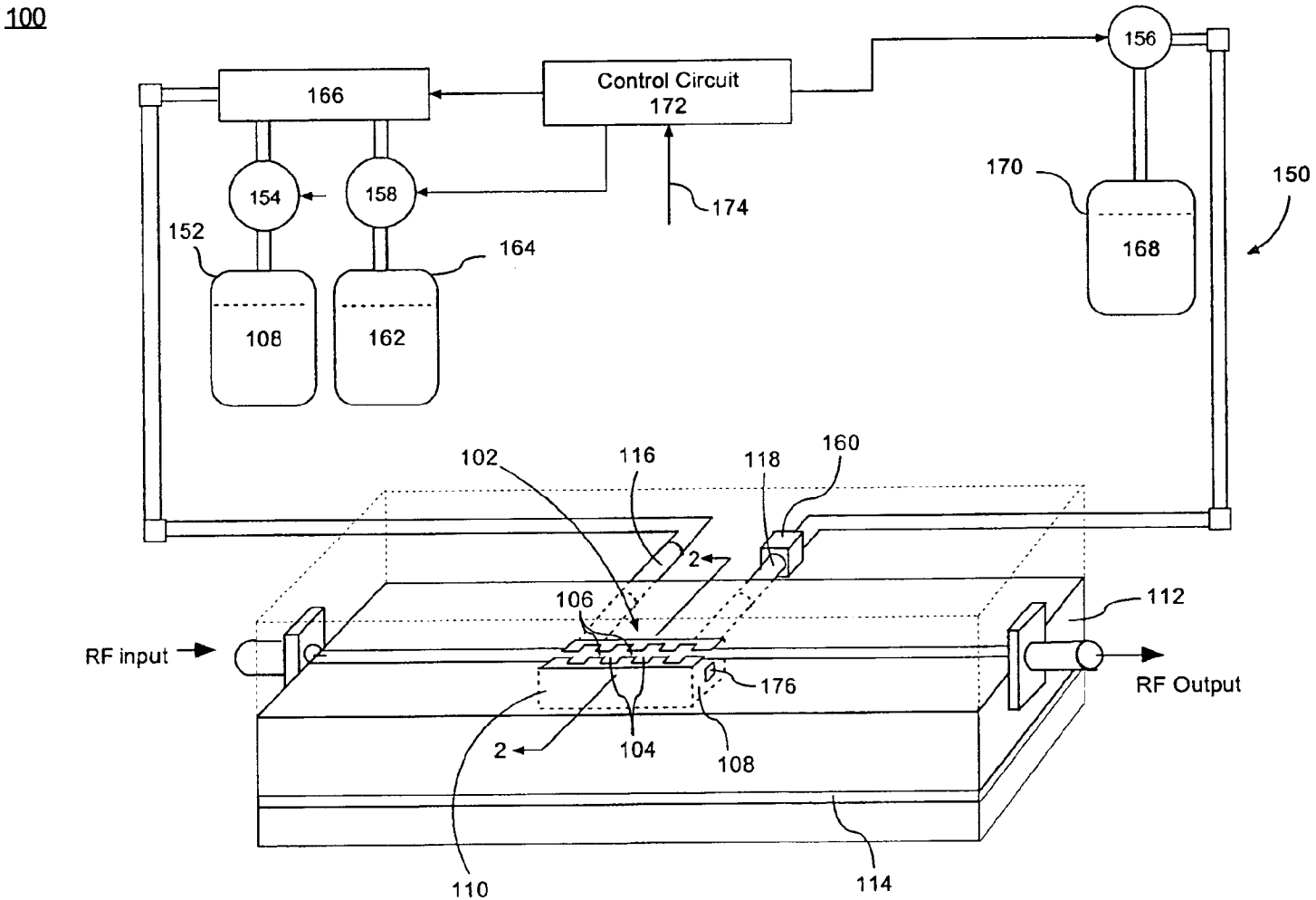
FIG. 1 is a conceptual diagram useful for understanding the variable filter of the invention.

FIG. 1 is a conceptual diagram that is useful for understanding the variable filter of the present invention. The filter apparatus 100 includes a filter 102 comprising filter elements 104, 106, also referred to as filter sections, at least partially coupled to a fluid dielectric 108. he filter elements 104, 106 can be transmission line segments have a predetermined geometry and a characteristic impedance. Further, the filter elements 104, 106 can be suspended over a ground plane 114, but the invention is not so limited.

In FIG. 1 the filter 102 has nine filter elements 104, 106, but it should be understood that the invention is not so limited. For example, the filter can have any number of filter elements. Moreover, the filter 102 can be a low pass filter, a band pass filter, a high pass filter, a band notch filter, a comb filter or any other type of filter that can be implemented on a substrate. Moreover, the filter topology can be any filter topology, for example, a stepped impedance filter, a constant impedance filter, a halfwave filter, a coupled resonator filter, a coupled line filter, a hairpin bandpass filter, and so on. For example, each filter element can be designed to have a specific characteristic impedance ($Z_0$) or input impedance ($Z_{in}$), which can vary from one element to the next. In another arrangement, filter elements can be adjacently positioned so that portions of the elements can be capacitively coupled. Further, resonant lines, which are well known to the skilled artisan, can be used as filter elements, for example to provide elements with inductive or capacitive impedances. Still, other filter structures can be used and will be understood to be included in the present invention.

The fluid dielectric 108 can be constrained within a cavity 110 that is generally positioned relative to the filter elements 102, 104 so as to be electrically and magnetically (electromagnetically) coupled thereto. In the most basic form, the invention can be implemented using a single cavity 110 that can be approximately commensurate with the area beneath that portion of the filter 102 where the filter elements 102, 104 are disposed. For example, the filter 102 can be disposed on a dielectric substrate 112 and the cavity can be formed within the dielectric substrate 112 so that walls of the cavity form a region bounded by the dielectric substrate 112. However, the cavity structure is not so limited and other embodiments are also possible. For example, a cavity can be formed in a dielectric material, such as plastic reservoir, which is sandwiched between the filter 102 and the ground plane 114. In another arrangement, fluid capillaries can be provided between the filter 102 and the ground plane 114.

Regardless of the particular structure selected for the fluid cavity 110, fluid dielectric 108 can be selectively injected into the cavity 110 to vary the permittivity and/or permeability of the region defined by the cavity 110. In one arrangement the cavity 110 can be completely filled with fluid dielectric 108. In another arrangement, the amount of fluid dielectric 108 within the cavity 110 can be adjustable to vary the permittivity and/or permeability within the region defined by the cavity 110.

The fluidic dielectric 108 can be injected into the cavity 110 to vary the capacitance between at least one of the filter elements 102, 104 and the ground plane 114, or the inductance of the filter elements 102, 104. These capacitance and inductance adjustments can be used to tune the filter for operation at selected frequencies. For example, adjustments can be made to the filter passband, stopband, center frequency, bandwidth, quality factor (Q), characteristic impedance, or any other filter parameter that can be adjusted by a change in permittivity and/or permeability. Capacitance and inductance values also can be adjusted to produce a desired filter response. Subsequently, by purging the fluid dielectric 108 from the cavity 110, the permittivity and permeability of the region defined by the cavity 110 can be adjusted. For example, the permittivity and permeability become equal, or substantially equal, to the permittivity and permeability of a vacuum or some other gas or fluid which is used to displace the fluid dielectric 108. In one embodiment, the fluid dielectric 108 can be replaced with a second fluid dielectric having a different permittivity and/or permeability than the first fluid dielectric 108.

Figure 2A:
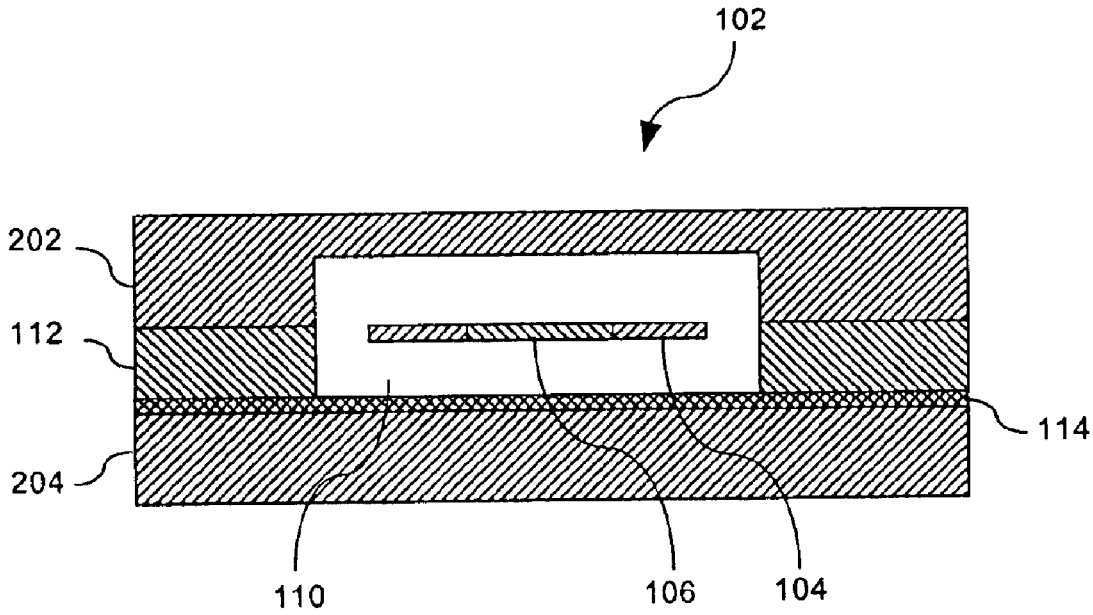
FIG. 2A is a cross-sectional view of the filter structure in FIG. 1, taken along section line 2—2.

FIG. 2A is a cross-sectional view of one embodiment of the filter elements in FIG. 1, taken along line 2—2, that is useful for understanding the invention. As illustrated therein, cavity 110 can be formed in substrate 112 and continued in cap substrate 202 so that the fluidic dielectric is closely coupled to filter elements. 104, 106 on all sides of the filter elements 104, 106. The filter elements 104, 106 are suspended within the cavity 110 as shown. The ground plane 114 is disposed below the filter elements 104, 106 between substrate 112 and a base substrate 204.

According to one aspect of the invention, the solid dielectric substrate 112, 202, 204 can be formed from a ceramic material. For example, the solid dielectric substrate can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention. Nonetheless, other dielectric substrates can be used and the invention is not so limited.

Figure 2B:
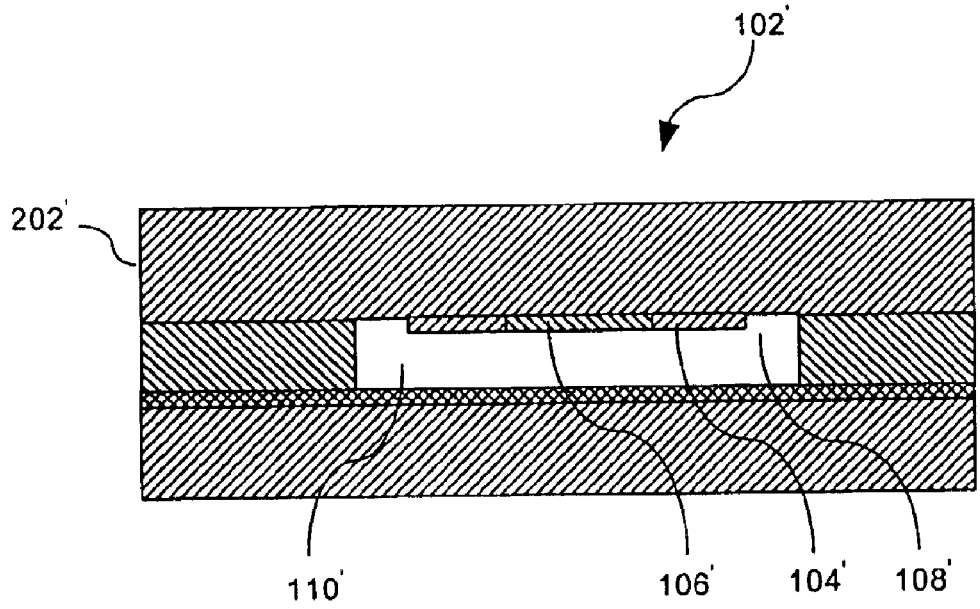
FIG. 2B is a cross-sectional view of an alternative embodiment of a filter structure of FIG. 1.

FIG. 2B is a cross-sectional view showing an alternative arrangement for the filter 102' in which the cavity structure 110' extends on only one side of the filter elements 104', 106' and the filter elements 104', 106' are partially coupled to the solid dielectric substrate 202'. In the case where the filter elements 104', 106' are also partially coupled to a solid dielectric, the permeability $\mu_r$ necessary to keep the characteristic impedance of the line constant can be expressed as follows:

$$\mu_r=\mu_{r,sub}(\in_r/\in_{r,sub})$$

where $\mu_{r,sub}$ is the permeability of the solid dielectric substrate 102', $\in_r$ is the permittivity of the fluidic dielectric 108 and $\in_{r,sub}$ is the permittivity of the solid dielectric substrate 102'.

The impedance of a transmission line is not independent of the transmission line structure. However, it is always proportional to the square root of the ratio of the permeability to the permittivity of the media in which the conducting structures are embedded. Thus, for any transmission line, such as the filter elements 104', 106', if both the permeability and permittivity are changed in the same proportion, and no other changes are made, the impedance will remain constant. The equation specified enforces the condition of a constant ratio of $\mu_r$ to $\in_r$ and thus ensure constant impedance for all transmission line structures.

At this point it should be noted that while the embodiment of the invention in FIG. 1 and FIG. 2 is shown essentially in the form of a buried microstrip construction, the invention herein is not intended to be so limited. Instead, the invention can be implemented using any type of transmission line by replacing at least a portion of a conventional solid dielectric material that is normally coupled to the transmission line with a fluidic dielectric as described herein. For example, and without limitation, the invention can be implemented in transmission line configurations including conventional waveguides, stripline, microstrip, coaxial lines, and embedded coplanar waveguides. Further, as noted, the filter can be provided with any filter configuration or filter topology. All such structures are intended to be within the scope of the invention.

Figure 3:
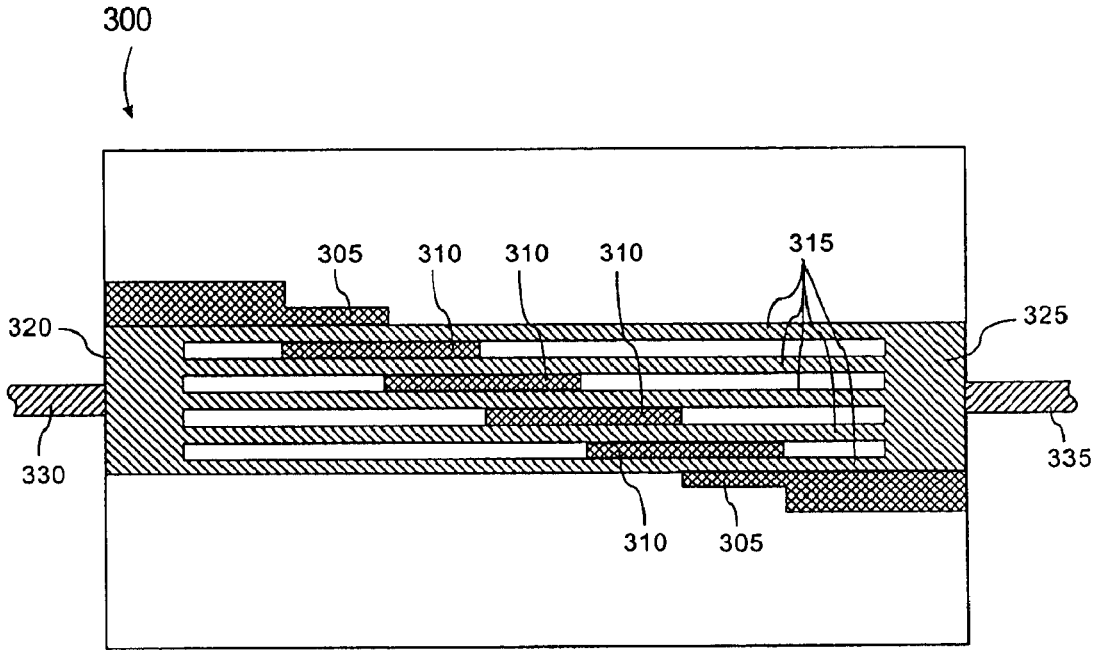
FIG. 3 is a top view of an alternate arrangement of the variable filter of the invention.

An example of a microstrip filter in a coupled line configuration is shown in FIG. 3. In this arrangement, the permittivity and/or permeability in regions adjacent to line segments can be adjusted to vary the coupling capacitance between the segments or vary the inductance of line segments. In particular, the capacitance and inductance can be controlled to vary filter performance characteristics.

The coupled line filter 300 can include input and output line segments 305 and intermediate line segments 310. Fluid channels 315 can be provided between adjacent line segments. The fluid channels 315 can be provided in any one of a variety of configurations which can be disposed between adjacent line segments. For example, the fluid channels 315 can be tubular, having either a rectangular or circular cross section.

Regardless of the particular structure selected for the fluid channels 315, the fluid dielectric 108 can be injected into the fluid channels 315 by means of a suitable fluid transfer conduit 330. A second fluid transfer conduit 335 can also be provided for permitting the fluid dielectric 108 to be purged from the fluid channels 315. Fluid distribution reservoirs 320 and 325 can be provided to facilitate fluid flow between the fluid transfer conduits 330, 335 and multiple fluid channels 315. By selectively injecting the fluid dielectric 108 into the fluid channels 315, the permittivity and/or permeability of the region defined by the fluid channels 315 can be changed. In one arrangement, the fluid channels 315 can be completely filled with fluid dielectric 108. In another arrangement, the amount of fluid dielectric 108 within the fluid channels 315 can be adjustable to vary the permittivity and/or permeability within the region defined by the fluid channels 315. In yet another arrangement, fluid dielectric 108 can be injected into selected fluid channels 315 while other fluid channels 315 remain unfilled.

In another example, one or more filter elements can comprise a resonant line, which typically has an electrical length that is some multiple of a quarter-wavelength of a selected frequency. The input impedance to a typical resonant line is resistive when the length of the resonant line is an even or odd multiple of the quarter-wavelength of the operational frequency, that is, the length of the resonant line corresponds to a location of a voltage minima or maxima on the resonant line. The input impedance to the resonant line has reactive components when the input to the resonant line is located between positions of voltage minima or maxima. Notably, the permittivity and/or permeability of the region defined by the cavity can be changed or varied to change the wavelength of a signal on the resonant line so that a particular multiple of the signal quarter-wavelength correlates to the length of the resonant line. Accordingly, impedance characteristics of the resonant line can be maintained constant as the frequency changes. Further, the permittivity and/or permeability of the region defined by the cavity can be adjusted to vary the signal wavelength so that the positions of relative voltage minima and maxima on the resonant line are adjusted. Accordingly, the input impedance of the resonant line can be varied to produce a desired filter response or to change a characteristic impedance of the filter.

Multiple Cavity Regions

In addition to the filter structures wherein a single cavity region is provided for the dielectric fluid, other arrangements can be implemented wherein multiple cavities are provided proximate to different portions of the filter. The permittivity and/or permeability in each region defined by cavities can be individually adjusted to tune filter parameters. This feature can be very useful during system development as it allows filter parameters in a prototype to be quickly and easily changed, thereby saving time and expense associated with fabricating a new filter each time an engineer wishes to fine tune filter parameters. For example, impedances of individual filter elements can be finely tuned to adjust a filter cutoff frequency or a characteristic impedance of a filter. Further, the elements of the filter can be tuned to provide a different filter transfer function. For example, the topology of a filter can be changed from a Butterworth topology to a Bessel topology.

Figure 4:
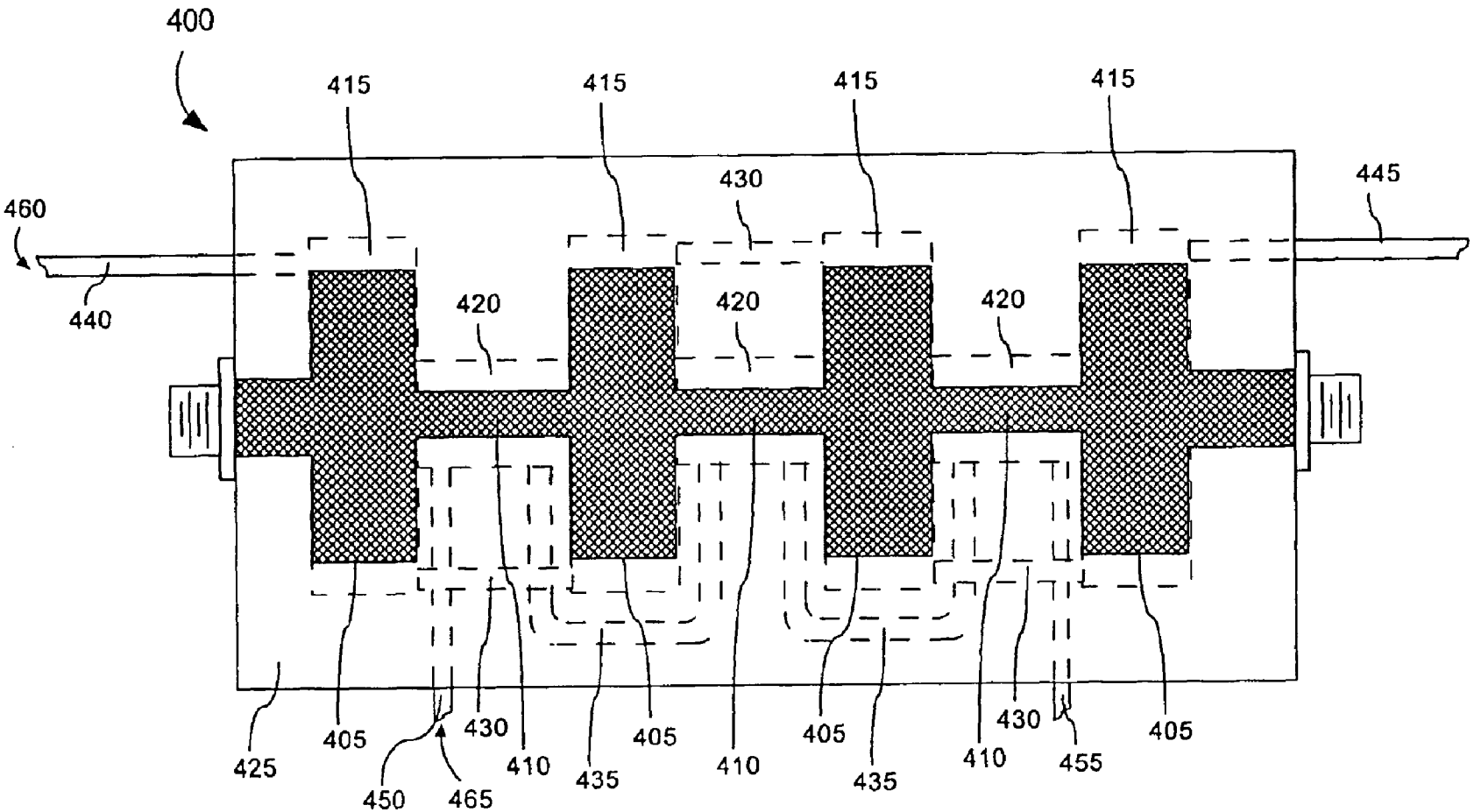
FIG. 4 is a top view of another alternate arrangement of the variable filter of the invention.

Further, in filters having multiple filter elements that require similar dielectric parameters, the cavity regions proximate to those filter sections can be coupled to share a same composition of dielectric fluid, as shown in FIG. 4. The figure shows a top view an exemplary filter 400 comprising low impedance filter elements 405 coupled to low impedance cavity regions 415 and high impedance filter elements 410 coupled to high impedance cavity regions 420. The cavity regions 415 and 420 can be contained within a dielectric substrate 425 and preferably extend completely beneath the respective filter elements 405 and 410, respectively. In an arrangement where desired characteristics for the low impedance filter elements 405 and the high impedance filter elements 410 are such that the filter elements 405 and 410 require different permittivity and/or permeability values, the low impedance cavity regions 415 and high impedance cavity regions 420 can be provided with different dielectric fluid compositions. For example, low impedance cavity regions 415 can be fluidly coupled together via conduits 430 and high impedance cavity regions 420 also can be fluidly coupled together via conduits 435. Further, the low impedance cavity regions 415 can be coupled to the composition processor with a first set of input and output conduits 440 and 445, and the high impedance cavity regions 420 can be coupled to the composition processor with a second set of input and output conduits 450 and 455. Notably, a second set of valves and sensors can be provided. Hence, a first apparatus can supply a first fluid dielectric 460 for the low impedance cavity regions 415 and a second apparatus can supply a second fluid dielectric 465 for the high impedance cavity regions 420.

Fluid Control System

Referring once again to FIG. 1, it can be seen that the invention preferably includes a fluid control system 150 for injecting the fluid dielectric 108 into the cavity 110 and/or removing the fluid dielectric 108 from the cavity 110. The fluid control system can comprise any suitable arrangement of reservoirs, pumps, valves and/or conduits that are operable to effectuate the injection and/or removal of the fluid dielectric 108. A wide variety of such fluid control systems may be implemented by those skilled in the art. For example, in one embodiment, the fluid control system can include a reservoir 152 for the fluid dielectric 108, a fluid transfer conduit 116, and a pump 154 for injecting the fluid dielectric into the cavity 110. A second fluid transfer conduit 118 can also be provided for permitting the fluid dielectric 108 to be purged from the fluid cavity 110.

When it is desired to purge the fluid dielectric from the cavity 110, a pump 156 can be used to draw the fluid dielectric from the cavity 110. A control valve 160 can be provided to allow the fluid dielectric to be purged from the cavity 110 as needed. Alternatively, in order to ensure a more complete removal of all fluid dielectric from the cavity 110, one or more pumps 158 can be used to inject a dielectric solvent 162 into the cavity 110. The dielectric solvent 162 can be stored in a second reservoir 164 and can be useful for ensuring that the fluid dielectric is completely and efficiently flushed from the cavity 110. A control valve 166 can be used to selectively control the flow of fluid dielectric 108 and dielectric solvent 108 into the cavity 110. A mixture 168 of the fluid dielectric 108 and any excess dielectric solvent 162 that has been purged from the cavity 110 can be collected in a recovery reservoir 170. For convenience, additional fluid processing, not shown, can also be provided for separating dielectric solvent from the fluid dielectric contained in the recovery reservoir for subsequent reuse. However, the additional fluid processing is a matter of convenience and not essential to the operation of the invention.

A control circuit 172 can be configured for controlling the operation of the fluid control system 150 in response to an analog or digital fluid control signal 174. For example, the control circuit 172 can control the operation of the various valves 160, 166 and pumps 154, 156, 158 necessary to selectively control the presence and removal of the fluid dielectric and the dielectric solvent from the cavity 110. It should be understood that the fluid control system 150 is merely one possible implementation among many that could be used to inject and purge fluid dielectric from the cavity 110 and the invention is not intended to be limited to any particular type of fluid control system. All that is required of the fluid control system is the ability to effectively control the presence and removal of the fluid dielectric 108 from the cavity 110.

A sensor 176 also can be provided which monitors fluid levels in the cavity 110 and provides fluid level data to the control circuit 172. Accordingly, the fluid control system can adjust fluid dielectric 108 levels within the cavity 110 to vary the permittivity and/or permeability in the cavity region. Pre-determined permittivity and/or permeability values correlating to various fluid levels can be predetermined for use by the controller in establishing proper fluid levels.

Composition of Fluid Dielectric

The invention is not limited to any particular fluid dielectric or dielectric solvent. Many applications require variable filters to be tunable over a wide frequency range. Accordingly, it may be desirable in many instances to select a fluid dielectric that has a relatively constant response over a broad range of frequencies. Moreover, for broadband applications, the fluids should not have significant resonances over the frequency band of interest. Further, fluid viscosity is a consideration. A fluid dielectric having a lower fluid viscosity may be easier to inject in to the fluid cavity and purge from the fluid cavity. Aside from the foregoing considerations, there are relatively few limits on the type of fluid dielectric that can be used.

Accordingly, those skilled in the art will recognize that the examples of fluid dielectric as shall be disclosed herein are merely by way of example and are not intended to limit in any way the scope of the invention. A nominal value of permittivity ($\in_r$) for certain exemplary fluids is approximately 2.0. However, the present invention can include fluids having extreme values of permittivity. For example, fluids could be selected with permittivity values ranging from approximately 2.0 to about 58. Typical fluid dielectrics can include oil, such as Vacuum Pump Oil MSDS-12602, which have low permittivity and low permeability, and/or solvents, such as such as formamide, which has high permittivity and low permeability. Accordingly, high permittivity can be achieved by incorporating solvents such as formamide into the fluid dielectric. Fluid permittivity also can be increased by adding high permittivity dielectric particle suspensions, for instance powders such as Barium Titanate manufactured by Ferro Corporation of Cleveland, Ohio.

The fluid dielectric also can be provided with a variety of levels of magnetic permeability ($\mu_r$). High permeability can be achieved in a fluid by introducing metal particles/elements to the fluid. For example, magnetic metals such as Fe and Co which have high levels of magnetic permeability can be incorporated into the fluid dielectric. Notably, some solid alloys of these materials can exhibit levels of ($\mu_r$) in excess of one thousand. It should be noted that fluids containing electrically conductive magnetic particles require a mix ratio low enough to ensure that no electrical path can be created in the mixture.

Other fluids comprise suspensions of ferro-magnetic particles, for example those commercially available from FerroTec Corporation of Nashua, N.H. 03060, in a conventional industrial solvent such as water, toluene, mineral oil, silicone, and so on. Magnetic particles such as metallic salts, organo-metallic compounds, and other derivatives also can be used in the fluid. Further, certain ferrofluids also can be used to introduce a high loss tangent into the fluid dielectric. The size of the magnetic particles found in such systems is known to vary to some extent. However, particles sizes in the range of 1 nm to 20 pm are common. The composition of particles can be selected as necessary to achieve the required permeability in the fluid dielectric. However, magnetic fluid compositions are typically between about 50% to 90% particles by weight. Increasing the number of particles will generally increase the permeability.

Importantly, any variety of permittivity and permeability ratios can be achieved by incorporating fluids having combinations of the above mentioned fluids and particules. For example, an oil having a suspension of ferromagnetic particles can be used as a low permittivity, high permeability fluid. A solvent having a suspension of dielectric and ferromagnetic particles can be used as a high permittivity, high permeability fluid. Still, many other fluid or fluid/particle combinations can be used. Additional ingredients such as surfactants can be included to promote uniform dispersion of the particles.

While the preferred embodiments of the invention have been illustrated and described, it will be clear that the invention is not so limited. Numerous modifications, changes, variations, substitutions and equivalents will occur to those skilled in the art without parting from the spirit and scope of the present invention as described in the claims.

We claim:

1. A variable RF filter, comprising:

at least one filter element;

a fluid dielectric; and a fluid control system for selectively moving said fluid dielectric from a first position, where said fluid dielectric is electrically and magnetically coupled to said filter element to produce a first filter response, to a second position, to produce a second filter response distinct from said first filter response.

2. The variable RF filter according to claim 1 wherein said filter element is formed from a structure selected from the group consisting of stripline, microstrip, and buried microstrip.

3. The variable RF filter according to claim 1 wherein at least one electrical characteristic of said filter response is changed when said fluid dielectric is moved from said first position to said second position.

4. The variable RF filter according to claim 1 wherein said electrical characteristic is selected from the group consisting of a passband, a stopband, a center frequency, a bandwidth, a quality factor (Q), and a characteristic impedance.

5. The variable RF filter according to claim 1 wherein said fluid control system includes a pump for moving said fluid dielectric between said first position and said second position.

6. The variable RF filter according to claim 5 wherein said first position is defined by a bounded region located adjacent to said filter element and said second position is defined by a fluid storage reservoir.

7. The variable RF filter according to claim 6 wherein said bounded region is bounded by at least one of a solid conductive material and a solid dielectric material.

8. The variable RF filter according to claim 1 wherein said fluid control system is responsive to a control signal for selectively moving said fluid dielectric between said first and second position.

9. The variable RF filter according to claim 1 wherein said fluid control system replaces said fluid dielectric with a second fluid dielectric responsive to a control signal.

10. The variable RF filter according to claim 1 further comprising a plurality of said filter elements, and said fluid control system selectively moves said fluid dielectric from a plurality of first positions, where said fluid dielectric is electrically and magnetically coupled to said filter elements, to a plurality of second positions.

11. The variable RF filter according to claim 10 wherein said fluid dielectric is magnetically and electrically decoupled from said fluid dielectric in said second position.

12. The variable RF filter according to claim 1 wherein an amount of said fluid dielectric in said first position is adjustable.

13. The variable RF filter according to claim 1 wherein said fluid dielectric is electrically and magnetically decoupled from said filter element in said second position.

14. A method for dynamically controlling a filter transfer characteristic of a variable RF filter, comprising the steps of:

producing a first filter transfer characteristic; and responsive to a control signal, changing said first filter transfer characteristic to a second filter transfer characteristic different from said first filter transfer characteristic by moving a fluid dielectric from a first position where said fluid dielectric is electrically and magnetically coupled to at least one filter element of said variable RF filter, to a second position.

15. The method according to claim 14 further comprising the step of selecting a permittivity and a permeability of said fluid dielectric, and a filter geometry, to provide at least two desired filter transfer characteristics when said fluid dielectric is moved from said first position to said second position.

16. The method according to claim 14 further comprising the step of selecting said filter element structure from the group consisting of stripline, microstrip, and buried microstrip.

17. The method according to claim 14 further comprising the step of operating a pump to move said fluid dielectric from said first position to said second position.

18. The method according to claim 14 further comprising the step of selecting said first position to be a bounded region located adjacent to said filter element and selecting said second position to be a fluid storage reservoir spaced apart from said filter element.

19. The method according to claim 14 further comprising the step of selectively moving said fluid dielectric from a plurality of first positions, where said fluid dielectric is electrically and magnetically coupled to a plurality of said filter element, to a plurality of second positions.

20. The method according to claim 19, further comprising the step of magnetically and electrically decoupling said fluid dielectric from said plurality of filter elements in said second positions.

21. The method according to claim 19 further comprising the step of independently controlling said movement of said fluid dielectric between said first and second positions with respect to a plurality of said filter elements.

22. The method according to claim 14 further comprising the step of moving said fluid dielectric between said first and second positions to change at least one electrical characteristic of said filter selected from the group consisting of a passband, a stopband, a center frequency, a bandwidth, a quality factor (Q), and a characteristic impedance.

23. Method according to claim 14 further comprising the step of electrically and magnetically decoupling said fluid dielectric from said filter element in said second postion.

* * * * *

UNITED STATES PATENT AND TRADEMARK OFFICE

CERTIFICATE OF CORRECTION

PATENT NO. : 6,867,666 B1
DATED : March 15, 2005
INVENTOR(S) : Rawnick et al.

It is certified that error appears in the above-identified patent and that said Letters Patent is hereby corrected as shown below:

Column 8,
Line 44, delete "pm" and replace with -- $\mu$m --.
Line 52, delete "particules" and replace with -- particles --.
Line 66, delete "parting" and replace with -- departing --.

Column 10,
Line 49, delete "Method" and replace with -- The method --.

Signed and Sealed this

Thirtieth Day of August, 2005

JON W. DUDAS
*Director of the United States Patent and Trademark Office*